US010088137B2

(12) United States Patent
Kawanami

(10) Patent No.: US 10,088,137 B2
(45) Date of Patent: Oct. 2, 2018

(54) LED MODULE

(71) Applicant: PANASONIC INTELLECTUAL PROPERTY MANAGEMENT CO., LTD., Osaka (JP)

(72) Inventor: Hiroki Kawanami, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 104 days.

(21) Appl. No.: 15/266,614

(22) Filed: Sep. 15, 2016

(65) Prior Publication Data

US 2017/0082275 A1 Mar. 23, 2017

(30) Foreign Application Priority Data

Sep. 18, 2015 (JP) ..... 2015-185589

(51) Int. Cl.
*F21V 23/02* (2006.01)
*F21Y 115/10* (2016.01)

(52) U.S. Cl.
CPC ..... *F21V 23/02* (2013.01); *F21Y 2115/10* (2016.08)

(58) Field of Classification Search
CPC ..... F21V 23/005; F21K 9/238; F21K 9/278
USPC ..... 362/249.02
See application file for complete search history.

(56) References Cited

U.S. PATENT DOCUMENTS 8,471,479 B2 6/2013 Tomiyoshi
8,829,537 B2 * 9/2014 Kuo ..... H05B 33/0803 257/79
2010/0157600 A1 * 6/2010 Chiang ..... F21K 9/00 362/249.02
2010/0194271 A1 * 8/2010 Tomiyoshi ..... G02F 1/133603 315/32
2015/0069452 A1 * 3/2015 Zanotto ..... H01L 33/005 257/99
2015/0300614 A1 * 10/2015 Tamura ..... G02B 6/4268 362/231

FOREIGN PATENT DOCUMENTS

JP 2005-116182 A 4/2005
JP 2009-231135 A 10/2009
JP 2013-004389 A 1/2013
JP 2013-258075 A 12/2013
WO 2009/016852 A1 2/2009

* cited by examiner

*Primary Examiner* — Laura Tso
(74) *Attorney, Agent, or Firm* — McDermott Will & Emery LLP

(57) ABSTRACT

An LED module includes a circuit board, multiple LEDs, and multiple electronic components for constituting a power supply circuit for lighting the multiple LEDs. The multiple LEDs are disposed on a first surface of the circuit board. The multiple electronic components are disposed on a second surface of the circuit board opposite to the first surface. At least some of the multiple electronic components are arranged so as to surround projections of the multiple LEDs projected onto the second surface of the circuit board in a thickness direction of the circuit board.

2 Claims, 4 Drawing Sheets

LED MODULE

CROSS-REFERENCE TO RELATED APPLICATION

The present application is based upon and claims the benefit of priority of Japanese Patent Application No. 2015-185589, filed on Sep. 18, 2015, the entire contents of which are incorporated herein by reference.

TECHNICAL FIELD

The present disclosure relates to a light emitting diode (LED) module.

BACKGROUND ART

There has been known light emitting diode (LED) modules such as a light source power supply module which includes: a printed wiring board; multiple light sources mounted on one surface of the printed wiring board; and multiple electronic components that are mounted on the surface, on which the two or more light sources are mounted, of the printed wiring board and constitute a power supply circuit (refer to JP 2013-4389 A, for example). The light sources are surface mounted LEDs, for example. The electronic components may include resistors, capacitors, transistors, transformers, and the like, for example.

In the field of the LED modules including power supply circuits, there is a demand for further improvement of the reliability.

SUMMARY

One of the objectives of the present disclosure is to provide an LED module capable of having improved reliability.

An LED module according to an aspect of the present disclosure includes a circuit board, multiple LEDs, and a power supply circuit for lighting the multiple LEDs. The multiple LEDs are disposed on a first surface of the circuit board. The power supply circuit includes multiple electronic components disposed on a second surface of the circuit board opposite to the first surface. At least some of the multiple electronic components surround projections of the multiple LEDs projected onto the second surface of the circuit board in a thickness direction of the circuit board.

BRIEF DESCRIPTION OF THE DRAWINGS

The figures depict one or more implementations in accordance with the present teaching, by way of example only, not by way of limitations. In the figures, like reference numerals refer to the same or similar elements.

DETAILED DESCRIPTION

Each figure mentioned in relation to Embodiments 1 and 2 is a schematic diagram, and dimensional ratios of components therein do not necessarily show actual dimensional ratios.

Embodiment 1

Figure 1C:
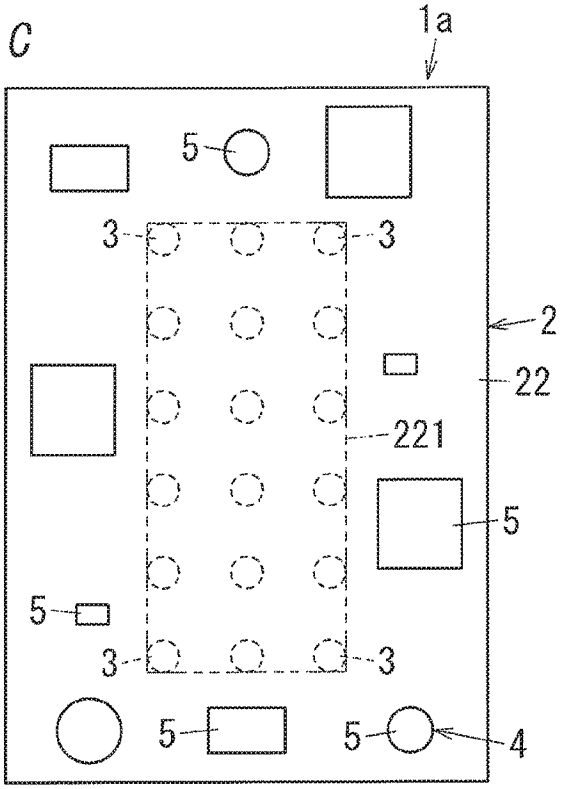
FIG. 1C is a schematic bottom view of the LED module according to Embodiment 1 of the present disclosure.
Figure 1A:
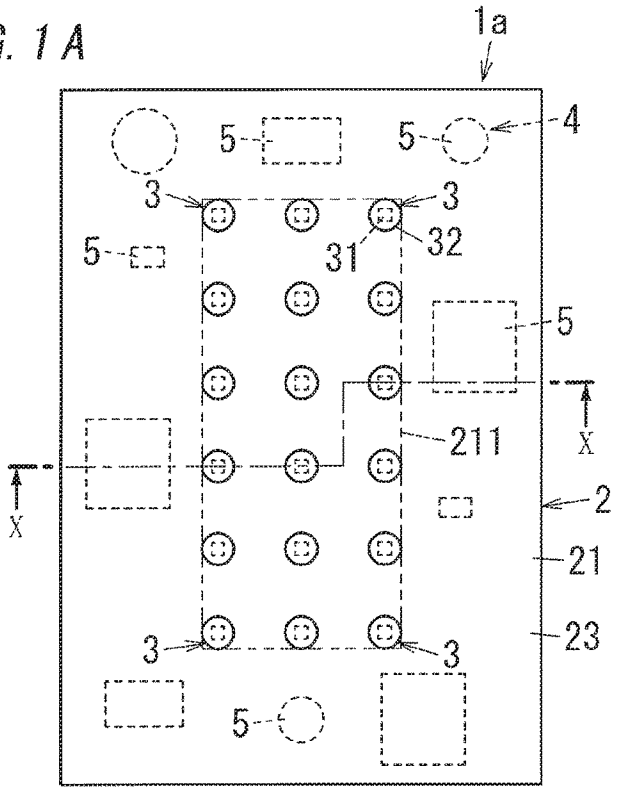
FIG. 1A is a schematic plan view of an LED module according to Embodiment 1 of the present disclosure.
Figure 1B:
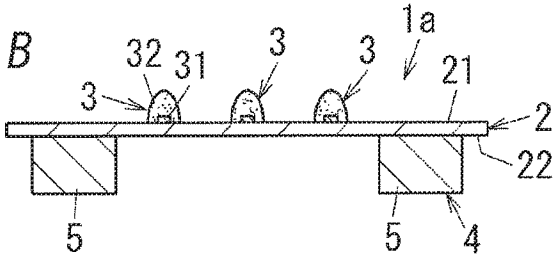
FIG. 1B is a sectional view taken along an X-X line of FIG. 1A.

An LED module 1*a* of the present embodiment will be explained with reference to FIG. 1A, FIG. 1B, and FIG. 1C.

The LED module 1*a* includes a circuit board 2, multiple LEDs 3, and a power supply circuit 4 for lighting the multiple LEDs 3. The multiple LEDs 3 are disposed on a first surface 21 of the circuit board 2. The power supply circuit 4 includes multiple electronic components 5 disposed on a second surface 22 of the circuit board 2 opposite to the first surface 21. A whole of the multiple electronic components 5 surround projections of the multiple LEDs 3 projected onto the second surface 22 of the circuit board 2 in a thickness direction of the circuit board 2.

With this configuration, reliability of the LED module 1*a* can be improved. In the LED module 1*a*, it is possible to reduce thermal load applied from the power supply circuit 4 on the multiple LEDs 3 as well as to reduce thermal load applied from the multiple LEDs 3 on the multiple electronic components 5. This can lead to suppression of reduction in luminous flux of the LEDs 3 and malfunction in the electronic components 5, and thus the LED module 1*a* can have enhanced reliability.

Components of the LED module 1*a* according to the present embodiment will be hereinafter explained in detail.

As described above, the LED module 1*a* includes the circuit board 2, the multiple LEDs 3, and the multiple electronic components 5.

The circuit board 2 is formed into a flat plate shape. A shape of the circuit board 2 in a plan view is a rectangular (right-angled quadrangular) shape. The shape of the circuit board 2 in the plan view represents a peripheral shape of the circuit board 2 seen along a thickness direction of the circuit board 2. The circuit board 2 is formed of a double-sided printed wiring board. Specifically, the circuit board 2 includes: first electric conductors provided on a front surface of an insulating substrate for connecting the multiple LEDs 3 in series so as to form a series circuit; and second electric conductors provided on a back surface of the insulating substrate for connecting the multiple electronic components 5 so as to form the power supply circuit 4. Therefore, the LED module 1*a* includes the power supply circuit 4 and the series circuit formed of the multiple (eighteen, in the illustrated example) LEDs 3 connected in series. In addition, two terminals for supplying power to the power supply circuit 4 are provided on the back surface of the insulating substrate. The circuit board 2 includes two through-hole conductors which electrically connect the power supply circuit 4 with the series circuit formed of the multiple LEDs 3 connected in series. The insulating substrate is a resin substrate. The resin substrate is a glass epoxy substrate, for example. Each of the first electric conductors, the second electric conductors, and the two terminals is formed of an electric conductive layer. The electric conductive layer is formed of a copper foil or the like. Preferably, the double-sided printed wiring board has high thermal conductivity. Preferably, the insulating substrate has the thermal conductivity equal to or greater than 1 W/(m·K), for example. For example, the double-sided printed wiring board is formed of a glass fabric/glass nonwoven fabric base material epoxy resin copper clad laminate in conformity with the Composite Epoxy Materials-3 (CEM-3) standard.

In the circuit board 2 of the LED module 1*a*, an LED mounting region 211 on which multiple LEDs 3 are mounted and an electronic component mounting region on which the multiple electronic components 5 are mounted are separated from each other in both the thickness direction and a planar direction of the circuit board 2. Hence, the heat dissipation structure can be easily designed in the circuit board 2.

In the circuit board 2, preferably, the first electric conductors cover a substantially whole of the front surface of the insulating substrate. With this configuration, the LED module 1*a* can efficiently release the heat generated in the multiple LEDs 3. The first electric conductors are electric conductors defining electrical connections of the multiple LEDs 3. Thus, the substantially whole of the surface should not be a whole of the surface in a strict sense, but is preferably 70% or more and less than 100% of the whole of the surface, more preferably 80% or more and less than 100% of the whole of the surface, and further preferably 90% or more and less than 100% of the whole of the surface.

Preferably, the circuit board 2 includes a white resist layer 23 for reflecting respective light from the multiple LEDs 3. In a case where the circuit board 2 includes the white resist layer 23, a surface of the white resist layer 23 serves as part of the first surface 21 of the circuit board 2. With this configuration, the LED module 1*a* can suppress optical absorption in the circuit board 2, and can increase the optical output thereof. Preferably, material of the white resist layer 23 is selected from a group including a white resist of fluorine resin, a white resist of epoxy resin and a white resist of silicone resin, for example.

Each of the multiple LEDs 3 is formed into a circular shape in a plan view. The shape of the LED 3 in the plan view represents a peripheral shape of the LED 3 seen along the thickness direction of the circuit board 2.

Preferably, color (chromaticity) of the multiple LEDs 3 is set based on correlated color temperature for LED color defined by JIS (Japanese Industrial Standards) Z9112:2012, for example. In JIS Z9112:2012, the LED color is classified into five types of daylight (D), neutral white (N), white (W), warm white (WW), and lamp (incandescent lamp) (L). In the LED module 1*a* of the present embodiment, each color of the multiple LEDs 3 is white (W), but is not limited to this.

Each of the multiple LEDs 3 includes an LED chip 31 and a wavelength conversion member 32.

The LED chip 31 is an LED chip for emitting blue light. Blue light from the LED chip 31 shows emission spectrum having a peak wavelength in a range from 440 nm to 480 nm. Preferably, the LED chip 31 has a square shape in a plan view, for example.

Preferably, the wavelength conversion member 32 is made of a mixture of phosphor particles and optically-transparent material, for example. Preferably, the optically-transparent material is material with high transmittance with respect to visible light. The optically-transparent material is silicone resin, for example. In this case, it is possible to improve heat resistance and weather resistance of the wavelength conversion member 32 in the LED module 1*a*. The silicone resin may include (non-modified) silicone resin and modified silicone resin. The wavelength conversion member 32 includes the above phosphor particles as wavelength conversion material for converting part of light from the LED chip 31 into light with a different wavelength to emit the converted light. For example, the phosphor particle is a yellow phosphor particle for emitting yellow light. Preferably, the light (fluorescence light) from the yellow phosphor particle shows emission spectrum with a peak wavelength in a range from 530 nm to 580 nm, for example. The yellow phosphor particle includes Eu-activated $SrSi_2O_2N_2$, for example.

In each of the multiple LEDs 3, the LED chip 31 is mounted on the first surface 21 of the circuit board 2, and the wavelength conversion member 32 is disposed on the first surface 21 of the circuit board 2 and covers the LED chip 31. The LED chip 31 mounted on the first surface 21 of the circuit board 2 means that the LED chip 31 is disposed on the first surface 21 of the circuit board 2 and mechanically connected to the circuit board 2, and also electrically connected with the first electric conductors of the circuit board 2. In short, the LED module 1*a* of the present embodiment is a chip on board (COB) LED module. Preferably, the wavelength conversion member 32 is formed by applying resin containing phosphor with a dispenser system, for example. The resin containing phosphor means optically transparent resin (silicone resin, for example) containing phosphor particles. Preferably, the dispenser system includes a controller for controlling a discharge amount of the resin containing phosphor from a nozzle. The dispenser system can therefore improve reproducibility of a shape obtained by applying the resin containing phosphor. The controller can be realized by installing an appropriate program on a microcomputer, for example.

The multiple LEDs 3 are arranged within the LED mounting region 211 of the first surface 21 of the circuit board 2 at regular intervals in a two dimensional array (in a matrix). Specifically, eighteen LEDs 3 are arranged at regular intervals in a 6 by 3 matrix. The LED mounting region 211 is an imaginary region, and is set in a center of the circuit board 2. The LED mounting region 211 is a region within which a whole of the multiple LEDs 3 are contained in a plan view, and has a rectangular shape smaller in size than the peripheral shape of the circuit board 2.

The power supply circuit 4 is a power conversion circuit for converting an input AC power into a DC power to output the DC power, for example. The power supply circuit 4 includes circuit components including a full-wave rectifier, a smoothing capacitor, a resistor, a resonance capacitor, a resonance inductor, a diode, a transformer, a switching device (metal-oxide-semiconductor field-effect transistor (MOSFET), for example), a control integrated circuit (IC) device, and the like. Each of these circuit components is one of the multiple electronic components 5. The smoothing capacitor is an electrolytic capacitor. The power supply circuit 4 includes a rectification-smoothing circuit, and a DC-DC converter. The rectification-smoothing circuit includes the full-wave rectifier and the smoothing capacitor. The DC-DC converter includes the resistor, the resonance capacitor, the resonance inductor, the diode, the transformer, the switching device, and the IC device for controlling the switching device. Each electronic component 5 is a chip component or a lead type electronic component.

Each of the multiple electronic components 5 is arranged so as not to overlap with any of the multiple LEDs 3 in the thickness direction of the circuit board 2. Specifically, the multiple electronic components 5 are arranged outside a vertical projection 221 of the LED mounting region 211 projected onto the second surface 22 of the circuit board 2. Each of the multiple electronic components 5 is arranged away from the vertical projection 221. The multiple electronic components 5 may include electronic components 5 generating relatively large amount of heat, and the electronic components 5 generating relatively large amount of heat are preferably arranged distant from one another. With this configuration, the LED module 1*a* can suppress an increase in temperature of the electronic components 5 caused by heat transfer between adjacent electronic components 5. The electronic components 5 generating a relatively large amount of heat may include, for example, the full-wave rectifier, the inductor, the transformer, the switching device, and the like. In the LED module 1*a*, adjacent electronic components 5 are away from each other in a direction parallel to a periphery of the circuit board 2, preferably.

In the LED module 1*a*, all the multiple LEDs 3 are disposed on the first surface 21 of the circuit board 2. In the LED module 1*a*, all the multiple electronic components 5 are disposed on the second surface 22 of the circuit board 2.

In the LED module 1*a*, the multiple electronic components 5 are arranged away from the vertical projection 221 of the LED mounting region 211 projected onto the second surface 22 of the circuit board 2. With this configuration, the LED module 1*a* can reduce the thermal load on the electrolytic capacitor serving as the smoothing capacitor. Accordingly, in the LED module 1*a*, it is possible to reduce the possibility of occurrence of malfunction in the power supply circuit 4.

In the LED module 1*a*, the whole of the multiple electronic components 5 are arranged so as to surround the projections of the multiple LED 3 projected onto the second surface 22 of the circuit board 2 in the thickness direction of the circuit board 2. Accordingly, the LED mounting region 211 can be downsized.

Embodiment 2

Figure 2B:
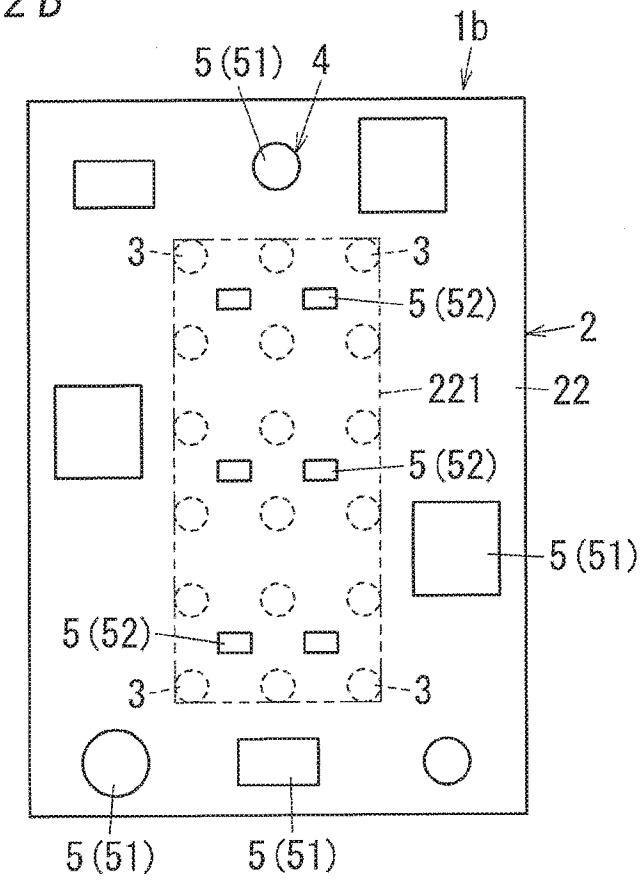
FIG. 2B is a schematic bottom view of the LED module.
Figure 2A:
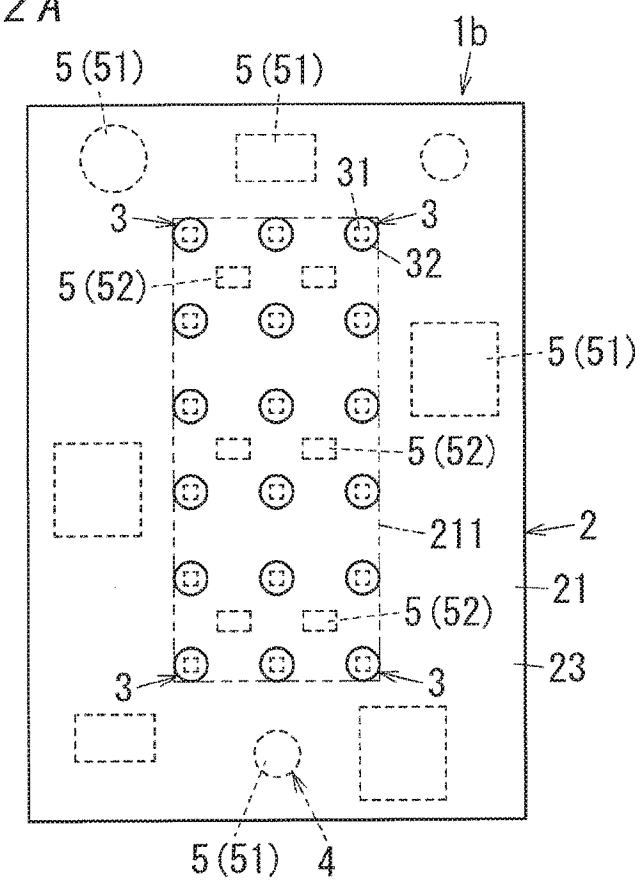
FIG. 2A is a schematic plan view of an LED module according to Embodiment 2 of the present disclosure.
Figure 3B:
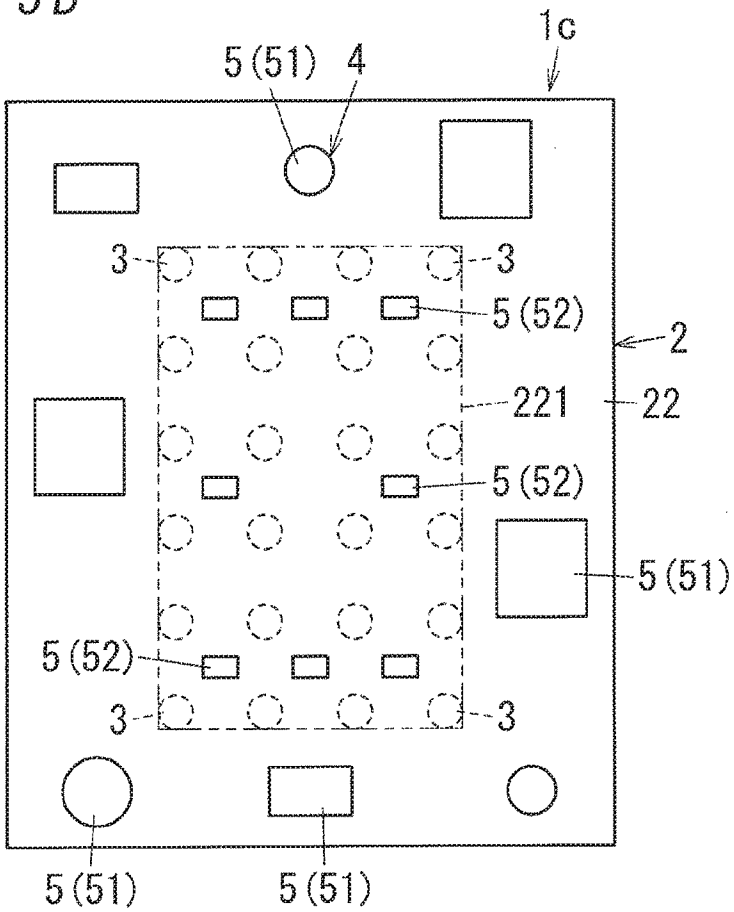
FIG. 3B is a schematic bottom view of the LED module.
Figure 3A:
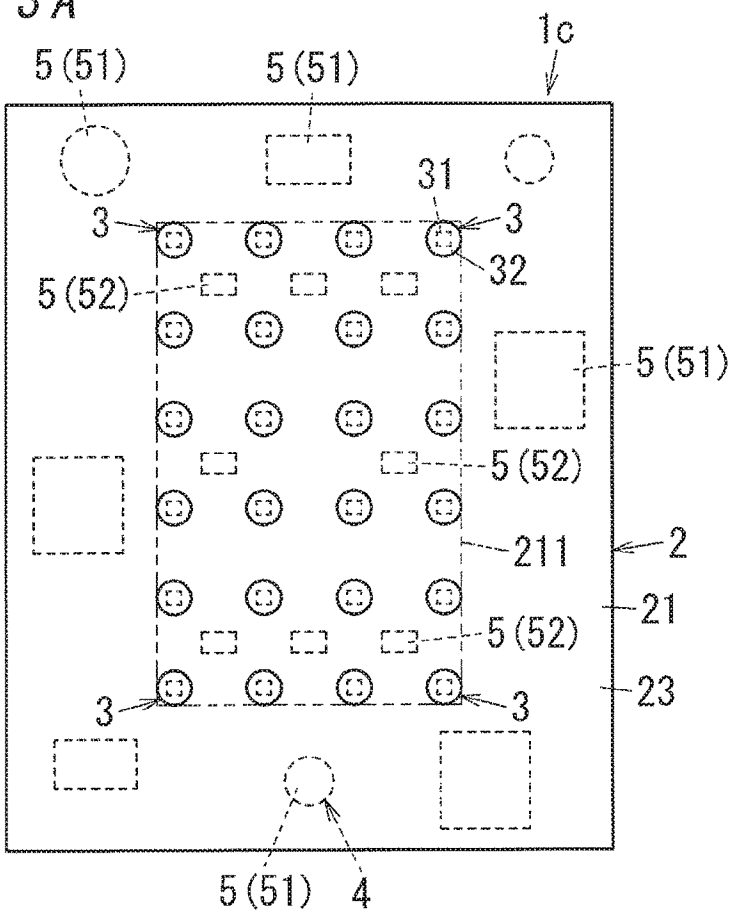
FIG. 3A is a schematic plan view of an LED module in a modified example according to Embodiment 2 of the present disclosure.
Figure 4B:
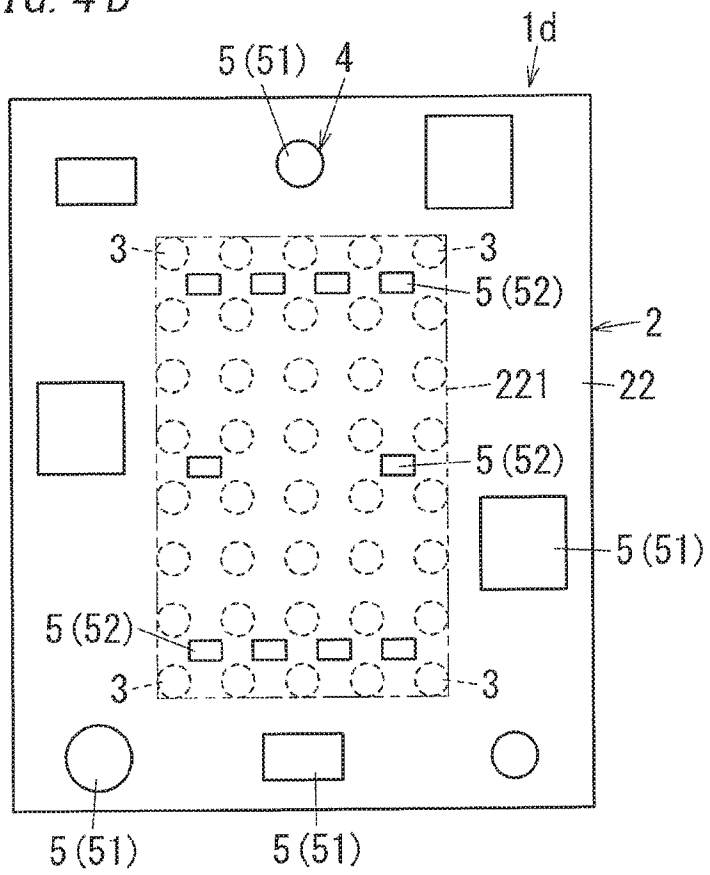
FIG. 4B is a schematic bottom view of the LED module.
Figure 4A:
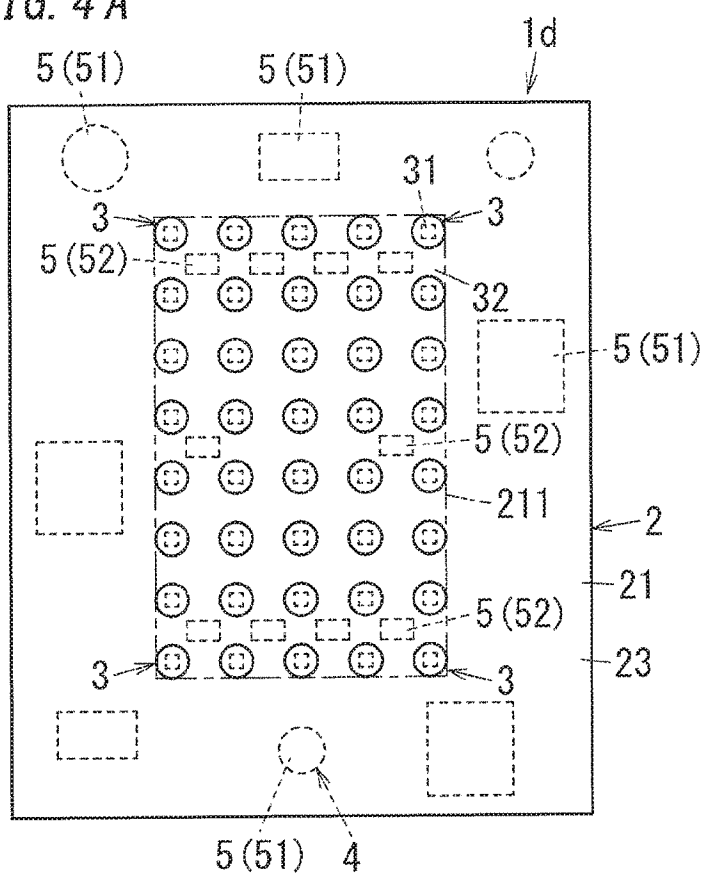
FIG. 4A is a schematic plan view of anther LED module in the modified example according to Embodiment 2 of the present disclosure.

An LED module 1*b* of the present embodiment will be explained with reference to FIG. 2A and FIG. 2B. With regard to the explanation of the LED module 1*b*, components common to the present embodiment and the LED module 1*a* of Embodiment 1 are designated by common reference signs and explanations thereof are omitted.

In the LED module 1*b*, some of multiple electronic components 5 surround projections of multiple LEDs 3 projected onto a second surface 22 of a circuit board 2 in a thickness direction of the circuit board 2. The multiple electronic components 5 include a group of electronic components (a first group of electronic components) 51 having relatively large planar sizes, and another group of electronic components (a second group of electronic components) 52 having relatively small planar sizes. In the LED module 1*b*, the first group of the electronic components 51 surround the projections of the multiple LEDs 3 projected onto the second surface 22 of the circuit board 2 in the thickness direction of the circuit board 2. In the LED module 1*b*, each of the second group of the electronic components 52 is disposed between adjacent ones of the projections of the multiple LEDs 3 projected onto the second surface 22 of the circuit board 2 in the thickness direction of the circuit board 2. With this configuration, in the LED module 1*b*, a distance between adjacent electronic components 5 can be made to be longer, and a distance between adjacent electronic components 51 having relatively large planar sizes can be made to be longer as well. In the LED module 1*b*, accordingly, it is possible to further reduce the thermal load on the electronic components 5. The LED module 1*b* thus can have more improved reliability. In this regard, for example, each electronic component 51 (electronic component 51 of the first group) may have a large planar size larger than a predetermined size. Each electronic component 52 (electronic component 52 of the second group) may have a small planar size equal to or smaller than the predetermined size. The predetermined size may be smaller than a size of a region surrounded by adjacent LEDs 3, for example. With regard to the electronic component 5, the planar size represents a size of the electronic component 5 in a plan view seen along the thickness direction of the circuit board 2.

The electronic component 51 having relatively large planar size would be larger in an amount of generated heat than the electronic component 52 having relatively small planar size.

The group of the electronic components 51 having relatively large planar sizes are mounted on the second surface 22 of the circuit board 2 and positioned outside a vertical projection 221 of the LED mounting region 211. Each of the electronic components 51 having relatively large planar sizes is arranged away from the vertical projection 221.

Each of the electronic components 52 having relatively small planar sizes is arranged so as not to overlap with any of the multiple LEDs 3 in the thickness direction of the circuit board 2. Each electronic component 52 having relatively small planar size is a chip component.

Hereinafter, LED modules 1*c* and 1*d* according to a modified example of Embodiment 2 will be explained with reference to FIG. 3A, FIG. 3B, FIG. 4A, and FIG. 4B. With regard to the explanation of the LED modules 1*c* and 1*d*, components common to the LED modules 1*c* and 1*d* and the LED module 1*b* of Embodiment 2 are designated by common reference signs and explanations thereof are omitted.

In each of the LED modules 1*c* and 1*d*, each electronic component 52 of the second group of the electronic components 52 is arranged in a peripheral region of a vertical projection 221 of the LED mounting region 211, within which the multiple LEDs 3 are mounted, of the circuit board 2. With this configuration, in the LED modules 1*c* and 1*d*, it is possible to reduce thermal load applied from the power supply circuit 4 on the multiple LEDs 3 as well as to reduce thermal load applied from the multiple LEDs 3 on the multiple electronic components 5, compared to the LED module 1*b*. In comparison with the LED module 1*b*, the electronic components 52 having relatively small planar sizes are arranged preferentially in a peripheral region of the vertical projection 221 in each of the LED modules 1*c* and 1*d*. In other words, in each of the LED modules 1*c* and 1*d*, the group of the electronic components 52 having relatively small planar sizes are arranged along a periphery of the vertical projection 221.

The materials, numerical values, and the like mentioned in relation to Embodiments 1 and 2 are given as examples, and there is no intent to limit the scope of the present disclosure by such examples. It is intended by the following claims to claim any and all modifications and variations that fall within the true scope of the present teaching.

For example, the circuit board 2 is not limited to having the rectangular shape in the plan view, but may have a circular shape or the like in the plan view.

Each of the multiple LEDs 3 may be a surface mounted LED, or a chip size package LED. The chip size package LED means an LED having a planar size that is the same as or slightly larger than a planar size (a chip size) of the LED chip 31. In a case where the planar size is slightly larger than a chip size of the LED chip 31, the chip size package LED has a package that is made from resin or the like and covers a front surface and sides of the LED chip 31. The front surface of the LED chip 31 means a surface which includes at least part of a light exit surface of the LED chip 31 and is on an opposite side of the LED chip 31 from the circuit board 2 when the chip size package LED is mounted on the circuit board 2.

Each of the multiple LEDs 3 may be a surface mounted LED for emitting monocolor light. The multiple LEDs 3 may include multiple kinds of LED with different emission colors, for example. The multiple LEDs 3 may include a group of first LEDs emitting white light and a group of second LEDs emitting lamp color light.

The shape of the LED mounting region 211 is not limited to a rectangle, but may be a circle or the like.

The phosphor particles are not limited to the yellow phosphor particles, but may include yellow-green phosphor particles, green phosphor particles, red phosphor particles, and the like. The wavelength conversion member 32 may include two or more kinds of phosphor particles.

Each of the LEDs 3 may include a sealing member made of optically-transparent material not containing phosphor particles, instead of the wavelength conversion member 32. The optically-transparent material is silicone resin, for example. The optically-transparent material is not limited to the silicone resin, but may be fluorine resin, low-melting-point glass, sol-gel glass, or the like. Preferably, the optically-transparent material is material with high transmittance with respect to visible light.

The connection of the multiple LEDs 3 are not limited to series connection, but may be parallel connection or parallel series connection.

The power supply circuit 4 may have a desired one of various kinds of appropriate circuit structures.

The invention claimed is:

1. A light emitting diode (LED) module, comprising:

a circuit board;

multiple LEDs disposed on a first surface of the circuit board; and a power supply circuit for lighting the multiple LEDs, the power supply circuit including multiple electronic components disposed on a second surface of the circuit board opposite to the first surface, wherein at least some of the multiple electronic components surround projections of the multiple LEDs projected onto the second surface of the circuit board in a thickness direction of the circuit board, the multiple electronic components include:

a first group of electronic components having relatively large planar sizes; and a second group of electronic components having relatively small planar sizes, the first group of the electronic components surround the projections of the multiple LEDs projected onto the second surface of the circuit board in the thickness direction of the circuit board, and each of the second group of the electronic components is disposed between adjacent ones of the projections of the multiple LEDs projected onto the second surface of the circuit board in the thickness direction of the circuit board.

2. The LED module of claim 1, wherein:

the multiple LEDs are mounted within an LED mounting region of the first surface of the circuit board, and each electronic component of the second group of the electronic components is arranged in a peripheral region of a projection of the LED mounting region projected onto the second surface of the circuit board.

* * * * *